US006196124B1

(12) United States Patent
Schaeffer

(10) Patent No.: US 6,196,124 B1
(45) Date of Patent: Mar. 6, 2001

(54) BALING MACHINE HAVING TWO PART EJECTOR RAM

(75) Inventor: Daniel J. Schaeffer, Sandusky, OH (US)

(73) Assignee: The American Baler Company, Bellevue, OH (US)

( * ) Notice: Subject to any disclaimer, the term of this patent is extended or adjusted under 35 U.S.C. 154(b) by 0 days.

(21) Appl. No.: 09/358,523

(22) Filed: Jul. 22, 1999

(51) Int. Cl.[7] ..... B30B 15/32

(52) U.S. Cl. ..... 100/218; 100/232; 100/237; 100/269.1

(58) Field of Search ..... 100/179, 193, 100/209, 208, 218, 232, 242, 269.08, 269.1, 237

(56) References Cited

U.S. PATENT DOCUMENTS

| | | | | |
|---|---|---|---|---|
| 2,748,694 | * | 6/1956 | Thompson | 100/232 |
| 3,005,403 | * | 10/1961 | Van Endert | 100/218 |
| 3,141,401 | | 7/1964 | Lindemann et al. . | |
| 3,384,007 | * | 5/1968 | Boje et al. | 100/269.1 |
| 3,603,245 | * | 9/1971 | Pioch | 100/269.1 |
| 3,945,315 | * | 3/1976 | Dahlem et al. | 100/232 |
| 4,205,604 | * | 6/1980 | Ashley | 100/232 |
| 4,658,719 | | 4/1987 | Jackson et al. . | |
| 5,007,337 | | 4/1991 | Newson . | |
| 5,081,922 | * | 1/1992 | Rudd, Jr. et al. | 100/218 |
| 5,175,981 | | 1/1993 | Gombos et al. . | |
| 5,201,266 | | 4/1993 | Schmalz et al. . | |
| 5,558,014 | | 9/1996 | Robinson . | |

FOREIGN PATENT DOCUMENTS

| | | | | |
|---|---|---|---|---|
| 3625336 | * | 2/1988 | (DE) | 100/232 |
| 0054750 | * | 6/1982 | (EP) | 100/237 |
| 53-26476 | * | 3/1978 | (JP) | 100/232 |

* cited by examiner

*Primary Examiner*—Stephen F. Gerrity
(74) *Attorney, Agent, or Firm*—Rankin, Hill, Porter & Clark, L.L.P.

(57) ABSTRACT

A baling machine includes a gathering chamber and a baling chamber. The gathering chamber includes a charging inlet through which material to be baled is delivered into the gathering chamber. The baling chamber communicates with the gathering chamber to allow compressed material to be forced from the gathering chamber into the baling chamber against the end wall. The baling chamber has a discharge outlet at one side for ejection of compressed material from the baling chamber. A gathering ram is reciprocal within the gathering chamber. The gathering ram includes a ram head movable between a retracted position and an advanced position to compress material in the gathering chamber and to drive compressed material into the baling chamber. An ejection ram is reciprocal within the baling chamber. The ejection ram includes a main ram head and an auxiliary ram head adjacent to each other. The main ram head and the auxiliary ram head are movable together between a retracted position and an advanced position to push compressed material from the baling chamber through the discharge outlet. The main ram head is separately movable between a retracted position and an advanced position while the auxiliary baling head is in its retracted position to push compressed material from the baling chamber through the discharge outlet. The dimensions of the baling chamber can thus be modified to permit bales of different sizes to be produced by a single baling machine. This allows smaller than usual bales to be produced if there is insufficient material to form a full sized bale.

4 Claims, 4 Drawing Sheets

BALING MACHINE HAVING TWO PART EJECTOR RAM

BACKGROUND OF THE INVENTION

1. Field of the Invention

This invention relates to machines for baling solid materials into a compact bale, and more particular to baling machines having two separate rams, one for gathering and compacting the material and the other for ejecting the compacted material through a discharge outlet.

2. Description of the Prior Art

Continuous extrusion type baling machines have been well known in the baling art and have long been used for baling waste material, such as paper, cardboard, used beverage cans, solid waste and the like. These baling machines have conventionally comprised a horizontal baling chamber having a floor, having sides for constraining the bale laterally and having a discharge passage from which the bales were ejected, and a feed hopper opening in the top side of the baling chamber for delivering the material to be baled. A ram having a forward platen or head reciprocated in the baling chamber past the feed hopper opening between a rearward position of retraction and a forward position of extension and compaction. The ram head was conventionally driven by a hydraulic cylinder mechanism.

In many baling machines, two rams have been used. The first ram gathered the material falling into the chamber from the hopper and compressed the material in the baling chamber against a solid end wall. The second ram extending generally transversely to the first ram ejected the compressed material from the baling chamber. The baling chamber in dual ram baling machines comprised the solid end wall opposite the gathering ram against which the material is compacted and a discharge passage opposite the ejection ram through which the finished bale was ejected from the chamber.

In operation, a charge of compressible material was dumped into the hopper and dropped into the gathering chamber when the gathering ram was retracted. The gathering ram was reciprocated back and forth between its retracted and extended positions, and successive charges were compressed and compacted together in the baling chamber against the solid end wall by the repeated strokes of the gathering ram head. After the material was compressed to its desired density, the gathering ram head was moved to a position at which its inner face formed one of the sidewalls of the baling chamber, and the ejection ram head was advanced to eject the bale through the discharge outlet on one side of the baling machine. An automatic strapping or tying mechanism was positioned at the discharge outlet. When a bale of compressed material was ejected from the baling chamber, the bale was bound and tied with a suitable number of wires.

Examples of dual head baling machines are shown in U.S. Pat. No. 3,613,556, issued to Wright et al.; U.S. Pat. No. 3,576,161, issued to Wright; U.S. Pat. No. 4,658,719, issued to Jackson et al.; U.S. Pat. No. 4,729,301, issued to Smith et al.; U.S. Pat. No. 5,007,337, issued to Newsom; U.S. Pat. No. 5,201,266, issued to Schmalz et al.; U.S. Pat. No. 5,558,014, issued to Robinson; and U.S. Pat. No. 5,081,922, issued to Rudd et al.; the disclosures of which are all hereby incorporated by reference.

A problem develops if there is insufficient material to form a full sized bale or if it is desired to create a bale which is less than full size. The effective size of the baling chamber of prior art machines has been fixed in size, with its dimensions determined by the front face of the gathering ram head when the gathering ram is in its advanced position, the front face of the ejection ram head when the ejection ram is in its retracted position, the solid end wall, and the discharge outlet. While the end wall may be retractable to accommodate the ejection of an oversized bale, it does not allow changing the effective size of the baling chamber. If less than the desired amount of material fills this chamber when the bale is completed, the result is a bale of less than desired density, and such a bale may be unstable and have a tendency to come apart during handling.

SUMMARY OF THE INVENTION

The present invention provides a unique baling machine design which overcomes the problems and shortcomings of the prior art. In accordance with the present invention, a dual head baling machine is provided in which the dimensions of the ejection or baling chamber can be modified to permit bales of different sizes to be produced by a single baling machine. This allows smaller than usual bales to be produced if there is insufficient material to form a full sized bale, and it allows for the forming and ejecting of bales of less than normal width on a continuous basis. These smaller than usual bales have the desired density and, therefore, are not prone to instability.

The baling machine of the present invention includes an ejection ram which has a ram head comprised of two parts—a main ram head and a smaller auxiliary ram head. In normal operation of the baling machine, both parts of the ejection ram head are operated to eject a full-sized bale of material from the baling chamber. The baling machine can also be operated in an auxiliary mode in which only the main ejection ram head is operated and the smaller auxiliary ram head is retained in its retracted position. In this mode, the front face of the gathering ram head is positioned adjacent to the side edge of the main ejection head and occupying the path of the auxiliary ram head. A smaller baling chamber is thus defined. When the material fills this smaller baling chamber, only the main ejection ram head is advanced to eject the compressed material from the baling chamber.

Each of the ram head portions of the ejection ram are separately operated by individual cylinders, each having its own piston connected to the ram head portion. The main ejection ram head can thus be operated separately and independently of the auxiliary ejection ram head. The two separate rams which comprise the ejection ram are in addition to the separate gathering ram, so that a total of three rams are provided in the baling machine of the present invention.

The auxiliary ejection ram head may also be provided with a locking flange on one side of the ram head which engages the main ejection ram head and prevents the auxiliary ejection ram head from being advanced unless the main ejection ram head is also advanced.

These and other advantages are provided by the present invention of a baling machine comprising first frame portion and a second frame portion. The first frame portion comprises a floor, an upper portion and side walls forming a gathering chamber. The gathering chamber includes a charging inlet through which material to be baled is delivered into the gathering chamber. The second frame portion comprises a floor, an upper portion and an end wall forming a baling chamber. The baling chamber communicates with the gathering chamber to allow compressed material to be forced from the gathering chamber into the baling chamber against the end wall. The baling chamber has a discharge outlet at one side for ejection of compressed material from the baling chamber. A gathering ram is reciprocal within the gathering chamber. The gathering ram includes a ram head movable between a retracted position and an advanced position to compress material in the gathering chamber and to drive compressed material into the baling chamber. An ejection ram is reciprocal within the baling chamber. The ejection ram includes a main ram head and an auxiliary ram head adjacent to each other. The main ram head and the auxiliary ram head are movable together between a retracted position and an advanced position to push compressed material from the baling chamber through the discharge outlet. The main ram head is separately movable between a retracted position and an advanced position while the auxiliary baling head is in its retracted position to push compressed material from the baling chamber through the discharge outlet.

DETAILED DESCRIPTION OF THE PREFERRED EMBODIMENT

Figure 1:
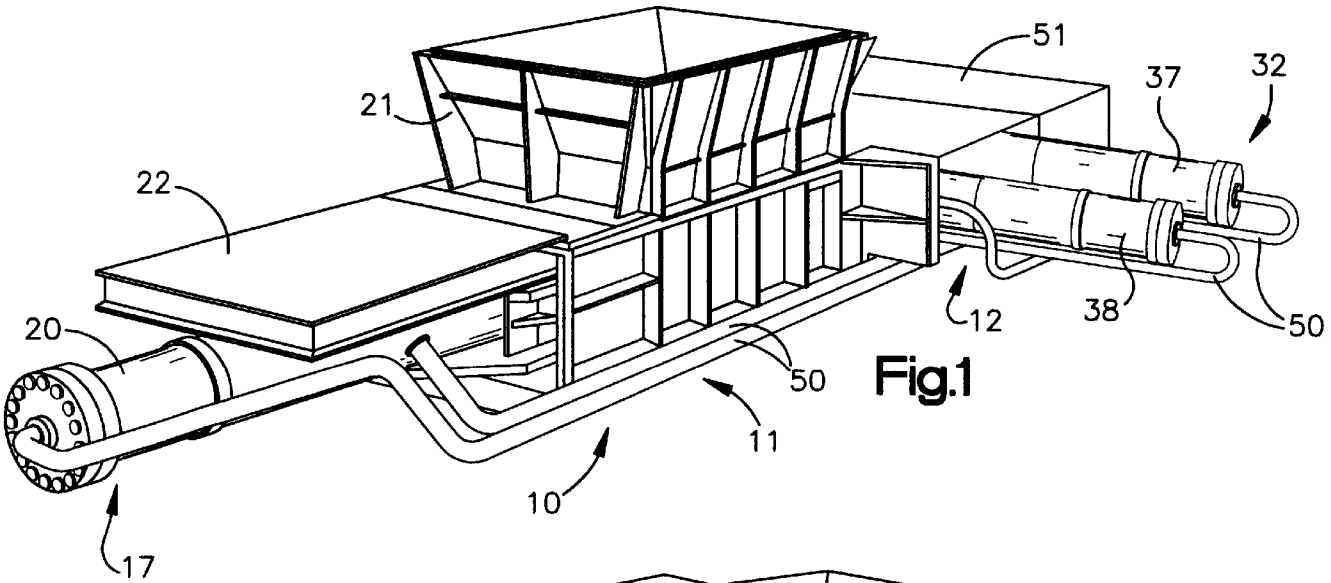
FIG. 1 is a perspective view of the baling machine of the present invention.
Figure 2:
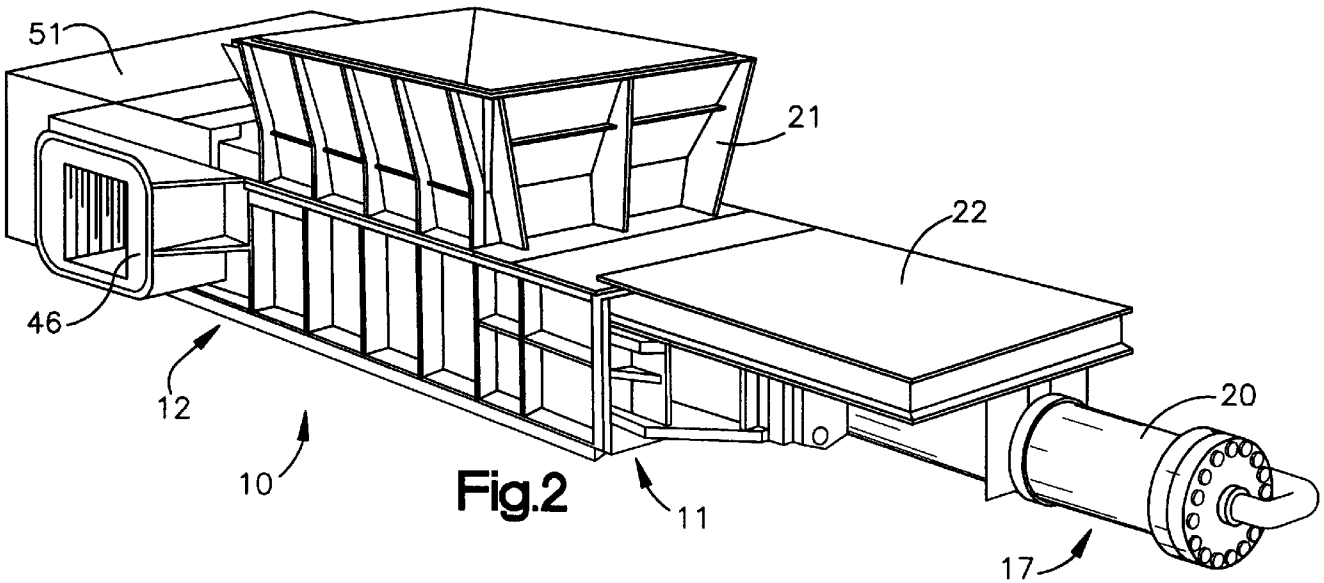
FIG. 2 is another perspective view of the baling machine of FIG. 1 from another angle.
Figure 3:
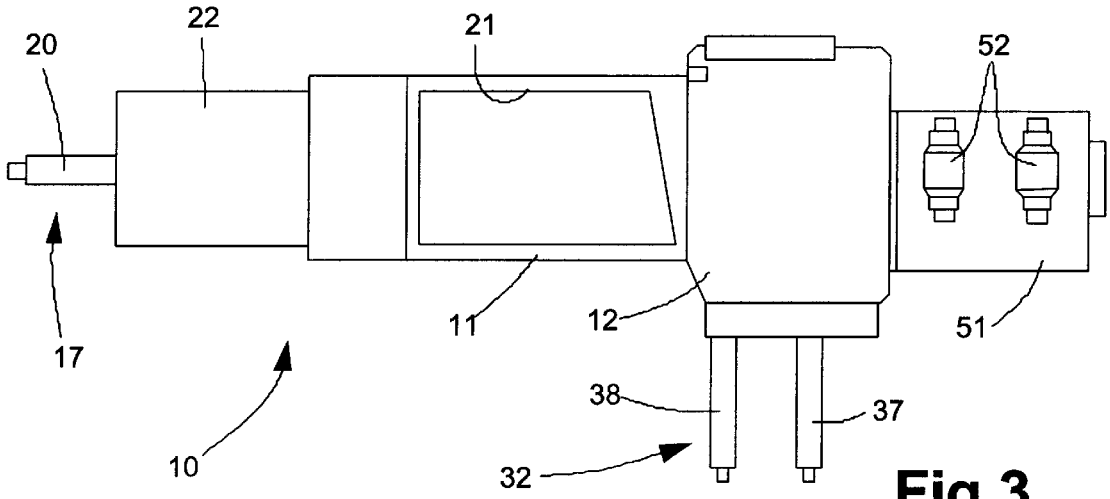
FIG. 3 is a simplified top plan view of the baling machine of FIGS. 1 and 2.
Figure 4:
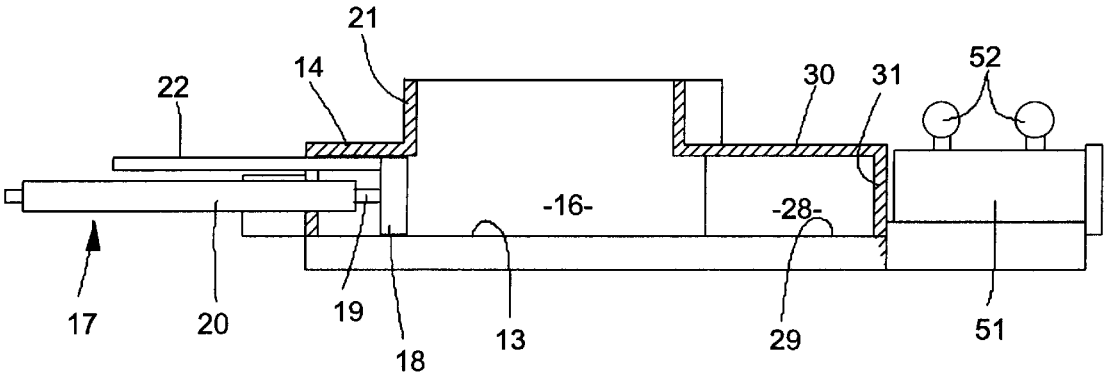
FIG. 4 is a simplified side elevational view of the baling machine of FIG. 3, partially in section.

Referring more particularly to the drawings and initially to FIGS. 1–4, there is shown a baling machine 10 according to the present invention. The baling machine 10 has a generally L-shaped support frame comprising a first frame portion 11 and a second frame portion 12. The first frame portion 11 includes a longitudinally extending floor 13. Extending parallel to and spaced above the floor 11 is an upper portion 14. Along the first frame portion 11, the floor 13 and the upper portion 14 are connected by enclosing sides 15 to form a gathering chamber 16. Within the gathering chamber 16 is a gathering ram 17 which comprises a platen or ram head 18 reciprocated back and forth through the gathering chamber by a piston rod 19 extending from a hydraulic cylinder 20. Above the gathering chamber 16, a charging inlet opening is formed in the upper side 12 to permit the gathering chamber to communicate with a feed hopper 21. Material to be baled is delivered into the baling chamber from the feed hopper 21 through the charging inlet. Although a conventional open feed hopper 21 is shown, it is understood that other types of hoppers can be used. For example, when baling certain materials, it may be preferable to use a weigh hopper. Suitable weigh hoppers are well known in the art and need not be described here. A cover plate 22 extends rearwardly from the top of the gathering ram head 18 and covers the charging inlet when the gathering ram head is in its advanced or forward position to prevent material from entering the gathering chamber behind the gathering ram head.

The cylinder 20 and piston rod 19 move the gathering ram head 18 between a retracted position and an advanced position. In the retracted position, the ram head 18 is substantially removed from the gathering chamber 16 to permit material to be delivered into the gathering chamber from the feed hopper 21 through the charging inlet. In the advanced position, the baling head 18 is moved substantially through the gathering chamber 16, the charging inlet is closed by the cover plate 22, and the material in the charging chamber is compressed into a baling chamber 28 which is formed in the second frame portion 12.

The second frame portion 12 of the baling machine comprises a horizontally extending floor 29 which is an extension of the floor 13, and a parallel upper portion 30 which is an extension of the upper portion 14. A solid end wall 31 extends from the floor 29 to the upper portion 30. The end wall 31 is positioned on one side of the baling chamber 28 opposite the gathering chamber 16 and provides the surface against which the material to be baled is pushed by the gathering ram 17. Within the baling chamber 28 extending generally perpendicularly to the gathering ram 17 is an ejection ram 32 which comprises a two part platen or ram head 33 and 34. The two part ejection ram head comprises a main ejection ram head 33 and a smaller auxiliary ejection ram head 34. Each of the ram heads and 34 is reciprocated back and forth through the baling chamber 28 by a piston rod 35 and 36, respectively, extending from a hydraulic cylinder 37 and 38, respectively. The smaller auxiliary ejection ram head 34 includes a locking flange 39 extending horizontally from the rear of one side of the ram head. The locking flange 39 engages the rear of the main ejection ram head 33 and prevents the auxiliary ejection ram head 34 from being moved forward through the baling chamber 28 unless the main ejection ram head 33 is also moved forward.

The cylinders 37 and 38 and piston rods 35 and 36 move the ram heads 33 and 34, respectively, between a retracted position and an advanced position. In the retracted position, the ram heads 33 and 34 are substantially removed from the baling chamber 28 to permit material to be compressed into the baling chamber 28 from the gathering chamber 16 by the gathering ram 17. In the advanced position, the ram heads 33 and 34 are moved substantially through the baling chamber 28 and the material in the baling chamber is ejected toward an open discharge outlet 46 provided on one side of the baling machine 10 at the forward end of the baling chamber 28. The discharge outlet 46 may be covered with an appropriate door mechanism 42 when the gathering ram 17 in accordance with convention design of dual ram baling machines as is well known in the art. After ejection from the baling chamber 28 through the discharge outlet 46, the compressed material may be tied into bales either manually or automatically using any suitable bale tying apparatus, such as that shown in U.S. Pat. No. 4,092,913.

The hydraulic cylinders 20, 37 and 38 are connected by suitable hydraulic lines 50 to a hydraulic reservoir contained in a housing 51 adjacent to the support frame 12. Electric motors 52 are also provided at the housing 51 which operate pumps (not shown) to operate the hydraulic system. The housing 51 may also contain a suitable hydraulic control system to control the operations of the baling machine. Hydraulic and control systems are commonly used to provide for the automatic operation of baling machines, and modification to conventional systems needed to operate the baling machine of the present invention need not be described in further detail.

Figure 5:
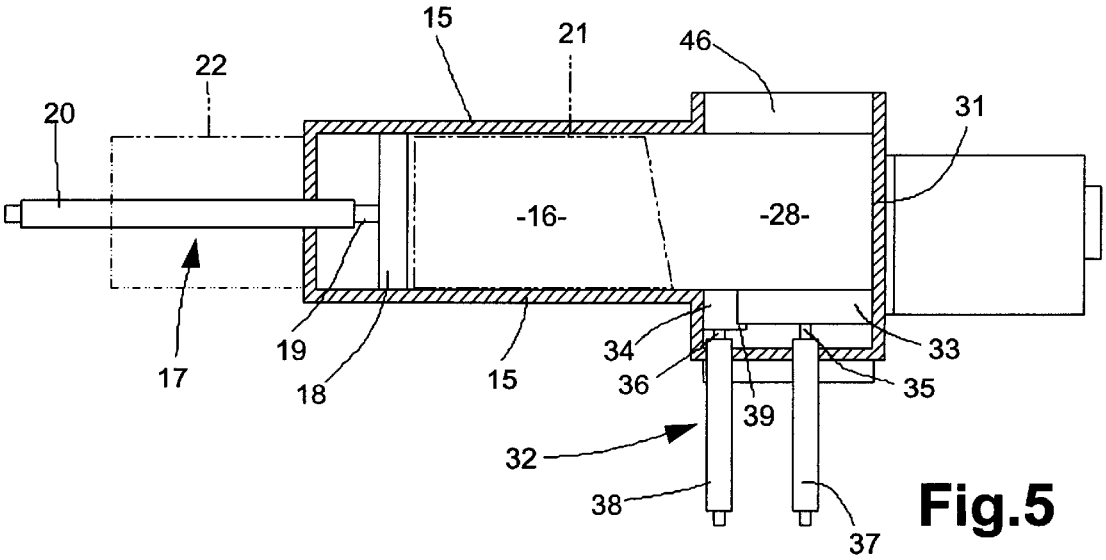
FIG. 5 is a simplified top sectional view of the baling machine taken along line 5—5 of FIG. 4 with both the gathering ram and the ejection ram fully retracted.
Figure 6:
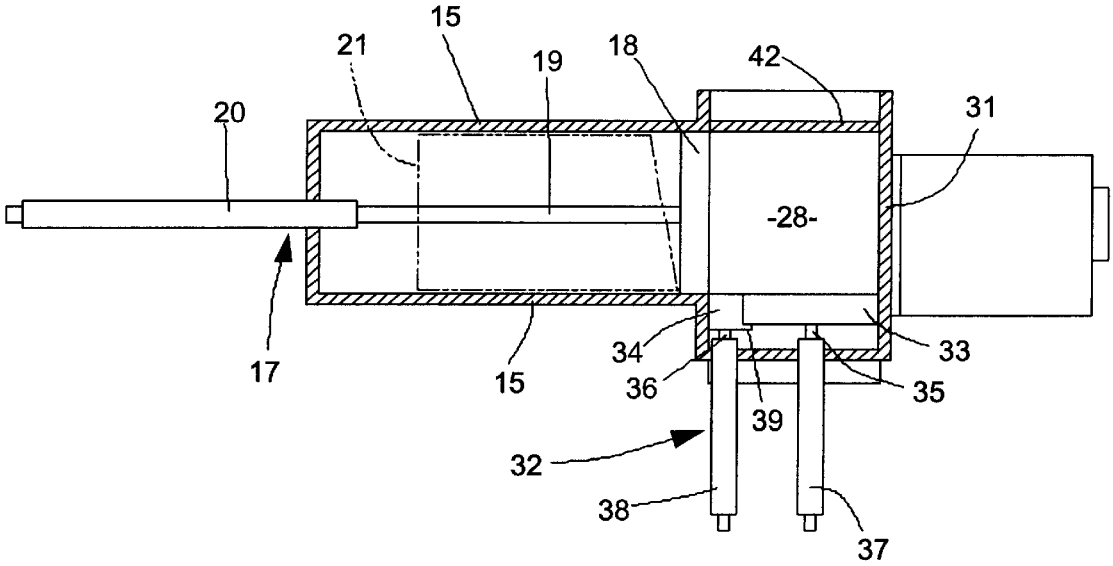
FIG. 6 is a top sectional view similar to FIG. 5 showing the gathering ram in its main advanced position and the ejection ram fully retracted.
Figure 7:
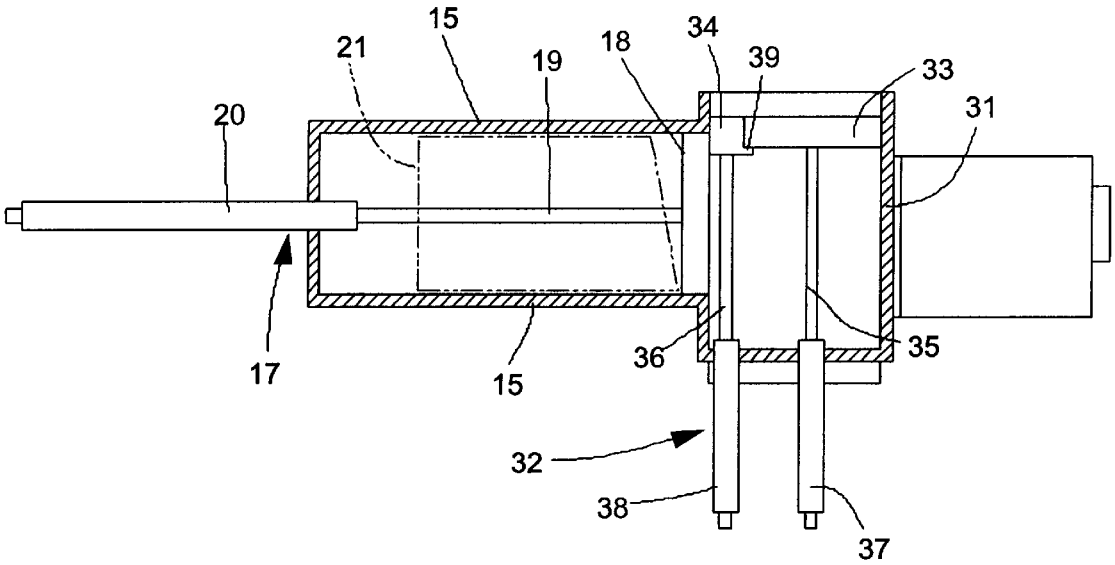
FIG. 7 is a top sectional view similar to FIGS. 5 and 6 showing the gathering ram in its main advanced position and the ejection ram in its advanced position.

In normal operation of the baling machine 10, the material to be baled is loaded into the feed hopper 21 and enters the gathering chamber 16 when the gathering ram head 18 is in its retracted position, as shown in FIG. 5. The gathering ram 17 is then operated to move the ram 18 head back and forth through the gathering chamber 16, taking successive charges of the material and compressing them against the end wall 31 in the baling chamber 28. When the baling chamber 28 is substantially full and the material has been suitably compressed, the gathering ram head 18 is positioned at its main advanced position as shown in FIG. 6 creating a baling chamber 28 with enclosed side walls, one side wall being formed by the front of the advanced ram head 18 and the other side wall being formed by the wall 31. The ejection ram heads 33 and 34 are then moved forward to eject the compressed material through the discharge outlet 46, as shown in FIG. 7.

Figure 8:
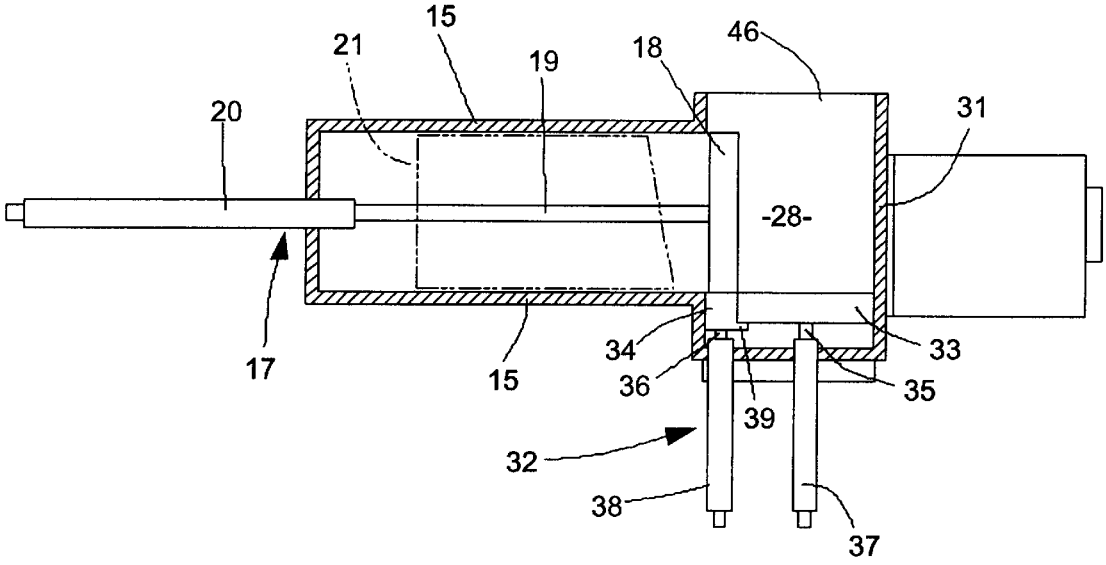
FIG. 8 is a top sectional view similar to FIGS. 5–7 showing the gathering ram in its auxiliary advanced position, and the ejection ram fully retracted.
Figure 9:
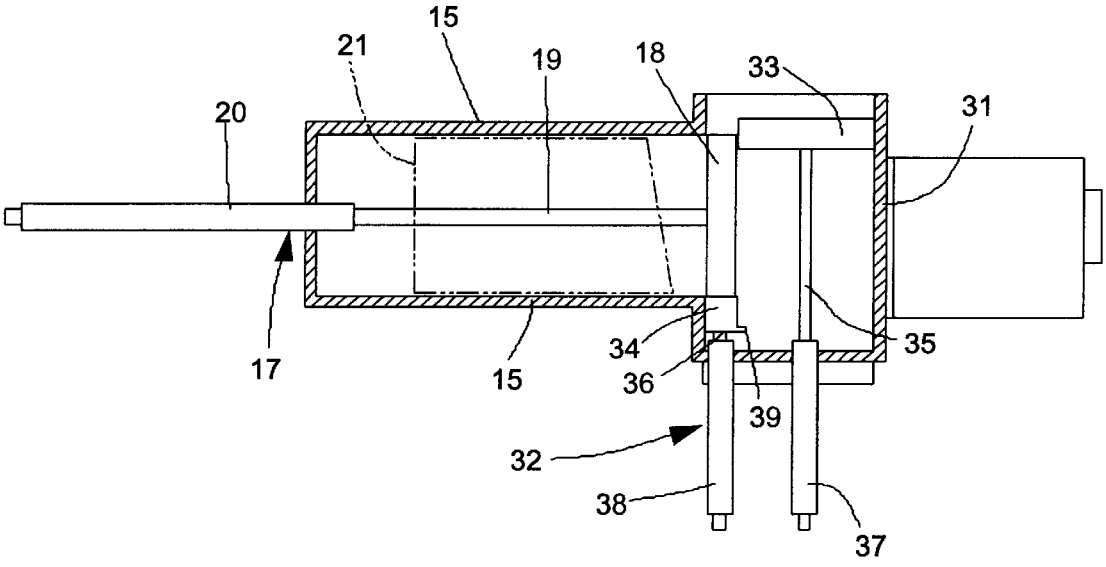
FIG. 9 is a top sectional view similar to FIGS. 5–8 showing the gathering ram in its auxiliary advanced position, and the ejection ram partially retracted and partially advanced for the ejection of smaller sized bales.

If there is not sufficient material available to form a full sized bale or if, for some other reason, it is desired to produce bales having a width that is less than normal, the baling machine 10 of the present invention can be operated to produce a smaller sized bale. In this mode of operation, the gathering ram 17 is operated as before to compress the material falling into the gathering chamber 16 from the feed hopper 21 into the baling chamber 28. The gathering ram head 18 is then positioned in a forward auxiliary position as shown in FIG. 8 which position is further advanced than the position of FIG. 6. In this position, the front of the gathering ram head 18 is generally flush with the demarcation between the ejection ram heads 33 and 34. This creates a narrower baling chamber 28. The main ejection ram head 33 is then advanced, while the auxiliary ejection ram head 34 is maintained in its retracted position. The smaller sized bale is thus pushed from the baling chamber 28 and out through the discharge outlet 46 solely by the main ejection ram head 33.

Other variations and modifications of the specific embodiments herein shown and described will be apparent to those skilled in the art, all within the intended spirit and scope of the invention. While the invention has been shown and described with respect to particular embodiments thereof, these are for the purpose of illustration rather than limitation. Accordingly, the patent is not to be limited in scope and effect to the specific embodiments herein shown and described nor in any other way that is is inconsistent with the extent to which the progress in the art has been advanced by the invention.

What is claimed is:

1. A baling apparatus which comprises:

a first frame portion comprising a floor, an upper portion and side walls forming a gathering chamber, the gathering chamber including a charging inlet through which material to be baled is delivered into the gathering chamber, a second frame portion comprising a floor, an upper portion and an end wall forming a baling chamber, the baling chamber communicating with the gathering chamber to allow compressed material to be forced from the gathering chamber into the baling chamber against the end wall, the baling chamber having a discharge outlet at one side for ejection of compressed material from the baling chamber;

a gathering ram reciprocal within the gathering chamber, the gathering ram including a ram head movable between a retracted position and an advanced position to compress material in the gathering chamber and to drive compressed material into the baling chamber; and an ejection ram reciprocal within the baling chamber, the ejection ram including a main ram head and an auxiliary ram head adjacent to each other, the main ram head and the auxiliary ram head movable together between a retracted position and an advanced position to push compressed material from the baling chamber through the discharge outlet, the main ram head separately movable between a retracted position and an advanced position while the auxiliary baling head is in its retracted position to push compressed material from the baling chamber through the discharge outlet.

2. A baling apparatus as in claim 1, comprising in addition a locking flange on the auxiliary ejection ram head which engages the main ejection ram head to prevent the auxiliary ejection ram head from moving toward its advanced position without the main ejection ram head moving toward its advanced position.

3. A baling apparatus as in claim 1, wherein the ejection ram includes separate ram cylinders for operating the main ram head and the auxiliary ram head.

4. A baling apparatus as in claim 1, wherein the gathering ram has two advanced positions, one of the advanced positions permitting movement of the auxiliary ejection ram head toward its advanced position, the other of the advanced positions blocking movement of the auxiliary ejection ram head from its retracted position.

* * * * *